United States Patent [19]

Luker

[11] Patent Number: 4,540,098

[45] Date of Patent: Sep. 10, 1985

[54] TAMPER INDICATING CHILD RESISTANT CLOSURE

[75] Inventor: Edward Luker, Evansville, Ind.

[73] Assignee: Sunbeam Plastics Corporation, Evansville, Ind.

[21] Appl. No.: 655,232

[22] Filed: Sep. 28, 1984

[51] Int. Cl.[3] ..... B65D 55/02

[52] U.S. Cl. ..... 215/216; 215/253; 215/254

[58] Field of Search ..... 215/216, 209, 330, 250, 215/253, 254

[56] References Cited

U.S. PATENT DOCUMENTS

| | | | |
|---|---|---|---|
| 4,413,743 | 11/1983 | Summers | 215/216 |
| 4,456,136 | 6/1984 | Palsson | 215/216 |
| 4,471,878 | 9/1984 | Davis et al. | 215/216 |

*Primary Examiner*—George T. Hall

*Attorney, Agent, or Firm*—Fisher, Crampton, Groh & McGuire

[57] ABSTRACT

A tamper indicating and child resistant package including a closure for use with a container having lock members. The closure has a top with concentric inner and outer skirts depending therefrom. The outer skirt is equipped with locking tabs for engaging the lock member on the container to prevent removal of the closure from the container. The locking tabs are deflectable radially outwardly upon radial inward squeezing of the outer skirt at predetermined diametrically opposed points which are circumferentially spaced from the lock tabs. A frangible, removable taper indicating means is provided to maintain the lock tab in circumferentially spaced relationship to the lock member and the squeeze points in alignment with ramp means on the container to prevent radial inward deflection and opening rotation of the closure until the tamper indicating means is broken away and removed.

11 Claims, 4 Drawing Figures

TAMPER INDICATING CHILD RESISTANT CLOSURE

This invention relates to screw-type closures for containers which are both child resistant and tamper indicating.

A variety of screw-type child proof or child resistant closures and containers have been provided which require two distinct operations to achieve opening. It is also desirable to have such closures be tamper proof or tamper indicating so that any attempt to open the container once it has been filled, is indicated by some means which can be readily observed. Also, it is desirable that the child resistant feature remains operable for repeated opening and closing whereas the tamper indicating arrangement is required to operate only the first time the container is opened.

It is an object of the invention to provide a child resistant tamper indicating closure.

The invention contemplates a child resistant tamper indicating package including a closure wherein a frangible, removable tamper indicating means is attached to the closure and engages a lock member on the threaded portion of the container to which the closure is preferably threadably attached. The closure is of the type that has a lock tab deflected radially outwardly upon radial inward squeezing of the cap at some predetermined diametrically opposed points circumferentially spaced from the lock tab so that the lock tab may pass lock members on the container for removal of the closure from the container. The tamper indicating means is frangible for removal from the closure and circumferentially spaced relative to the lock member whereby it is impossible to remove the closure without first removing the tamper indicating means. The tamper indicating means is a removable tab which acts to restrain the closure from clearing a ramp provided on the container. When the tamper indicating means is removed, the closure may be rotated for removal from the container. The removed tamper indicating tab alerts the vendor or purchaser of possible prior opening.

A preferred embodiment of the invention is disclosed in the drawings in which.

Figure 1:
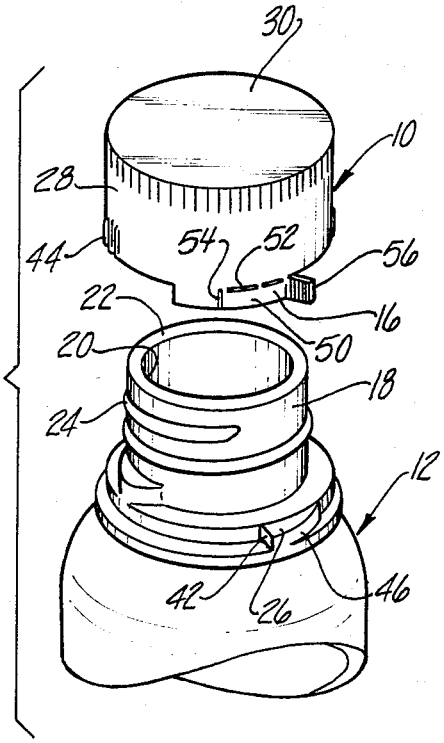
FIG. 1 is an exploded perspective view of a closure and container embodying the invention.
Figure 2:
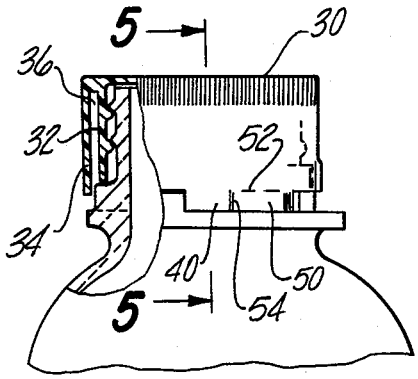
FIG. 2 is a partial sectional view of the closure and container.

The child resistant and tamper indicating closure and container arrangement 8 of the present invention includes a closure 10 and a container 12. The basic closure arrangement is of the child resistant type in that it requires two dissimilar motions in order to bring about a removal of the closure 10 from the container 12. In the present instance, the basic closure requires squeezing and simultaneous rotation of the closure in order to remove it from the container. Reapplication of the closure 10 to the container 12 is accomplished by a single form of motion, that is, by threading or rotating the cap onto the container.

In addition to the child resistant features, the closure 10 and container 12 include tamper indicating features in which a tamper indicating means indicated generally at 16 requires removal before the child resistant mechanism can be brought into operation. Absence of the tamper indicating means gives evidence that the container has previously been opened or at least put into a condition in which it could be opened.

The closure 10 is applied to the neck 18 of the container 12. The neck 18 forms an opening 20 surrounded a sealing lip 22. Screw threads 24 are formed on the exterior of the neck 18 and a lock member 26 is molded or formed integrally with the neck at a point immediately below the threads 24.

The basic closure portion for closing the opening 20 in the container 12 is formed by a cap portion 28. The cap portion 28 includes a disc-shaped top 30 having the inner wall or skirt 32 and a concentric outer wall or skirt 34. The walls 32 and 34 are spaced to form an annular groove 36. The inner wall 32 is provided with threads 36 which are complementary to the threads 24 on the closure neck 18 and are the means by which the closure 10 is maintained on the container 12.

The outer wall 34 of the cap portion 28 is provided with a lock element 40 which in the closed position of the cap portion 28 on the container 12 is circumferentially aligned with the lock member 26 so that unscrewing of opening rotation of the cap portion 28 is obstructed by the engagement of the lock member 26. To place the cap portion 28 in condition for removal, it is necessary to deflect the outer wall 34 radially inwardly. This is accomplished by squeezing the outer wall of the cap portion 28 at diametrically spaced points indicated at 44 in FIG. 4. This causes the lock elements 40 to flex radially outwardly an amount sufficient to clear the lock surface 42 so that the cap portion 28 can be rotated by maintaining a grip on the cap portion 28 at the squeeze points 44 and simultaneous rotation of the cap portion 28 it can be removed or unthreaded from the neck 18 of the container 12.

The cap portion 28 can be reapplied to the container 12 to close the opening 20 by simply rotation in a closing direction. During such rotation, the lock element 40 engages the cam surface 46 adjacent to the lock surface 42 on the lock member 26 to permit the lock element 40 to be deflected and to pass the lock member 26. When the cap portion 28 reaches its fully closed and sealed condition, the lock element 40 is circumferentially aligned with the lock surface 42 and opening movement will again require two dissimilar motions, namely, squeezing the cap portion 28 at diametrically spaced locations 44 and simultaneous rotation of the cap portion 28 in an opening direction.

The tamper indicating means 16 includes a tab element 50 which is detachably connected to the cap 28 by means of frangible webs or a line of weakening 52 to the bottom edge of the outer wall 34 and by a line of weakening 54 to one side edge of the lock element 40. The tab element 50 is provided with a grip portion 56 by which it is possible to hold the grip portion between the thumb and forefinger to remove the tab element 50 from the closure. The tab element 50 is disposed to one side of the lock element 40 in the direction of opening movement of the closure 10 relative to the container 12. When the closure 10 is in place on a container 12, the tab element 50 serves to maintain the lock element 40 circumferentially spaced from the lock surface 42 on the lock member 26. In that position, the squeeze points 44 are in a radial alignment with a pair of diametrically opposed ramps 60 formed on the neck 18. The ramps 60 engage the inner surface of the outer wall 34 to prevent radial inward deflection of the squeeze points 44. This also prevents the possibility of radial outward movement of the lock element 40 which must first be accomplished before there can be rotation of the cap 28 in an opening direction.

Figure 3:
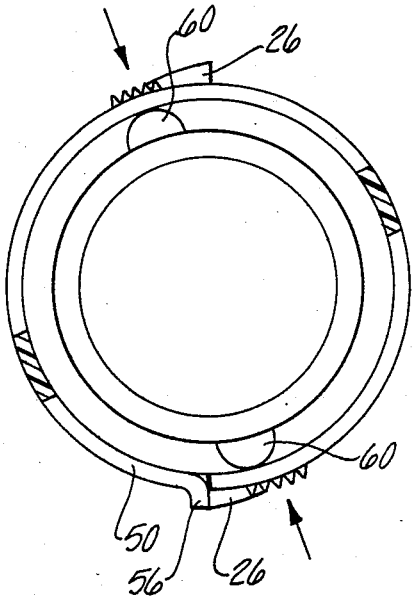
FIG. 3 is a cross-sectional view taken on line 3—3 in FIG. 2.
Figure 4:
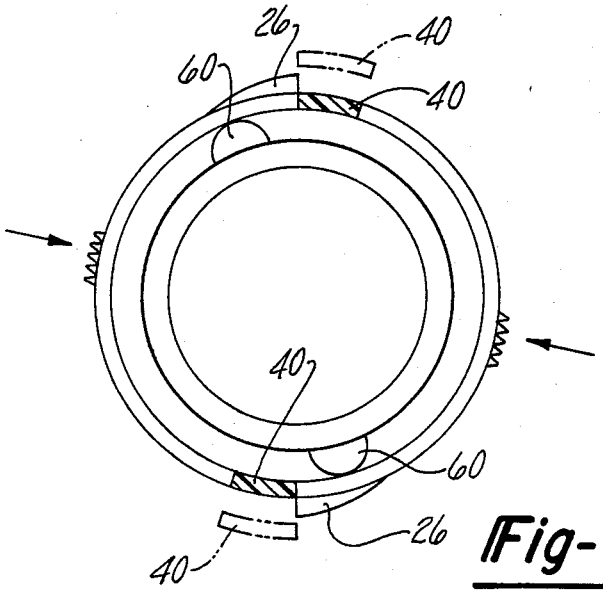
FIG. 4 is a cross-sectional view similar to FIG. 3 but showing another condition of operation.

The ramps 60 are disposed above the lock members 26 and are disposed in diametrically opposed relationship to each other. There is no specific relative positioning of the ramps 60 relative to the lock member 26 in a circumferential direction. However, the preferred location of the squeeze points 44 is approximately 90 degrees from the lock elements 40 so that when a pair of lock elements 40 are used, squeezing occurs midway therebetween. That being the case, the location of the ramps 60 preferably is in radial alignment with the lock elements 40 as shown in FIGS. 3 and 4. Under such conditions, the lock elements 40 are located approximately 90 degrees from the lock surfaces 42 on the lock members 26. The circumferential extent of the tab element 50 must be such that it extends from the lock element 40 to one of the lock surfaces 42 when the squeeze points 44 are in alignment with the ramp 60.

To bring about opening movement of the package 8, the grip portion 56 is held between the thumb and forefinger and the tab element 50 is broken away along the lines of weakening 52 and 54 to separate the tab element 50 from the cap 28. Thereafter, the cap 28 can be rotated in an opening direction through an arc of approximately 90 degrees until the lock element 40 engages the lock surface 42 on the lock member 26. In such a position, the squeeze points 44 will have been moved out of radial alignment with the ramp 60 as illustrated in FIG. 4. In that condition, the squeeze points 44 can be pressed toward each other which causes the lock elements 40 to move radially outwardly to the broken line position illustrated in FIG. 4 to permit subsequent turning movement in an opening direction which in FIG. 4 is counterclockwise. By simultaneous holding the squeeze points 44 to maintain the lock elements 40 radially outward, the cap 28 can be unthreaded from the closure.

Although the child resistant and tamper indicating package can be made to operate properly with a single lock member 26 and lock element 40, it is preferable to use a pair of diametrically opposed lock members 26 and a pair of diametrically opposed lock elements.

When the closure 10 is applied to a container for the first time, the cam surfaces 46 serve to move not only the lock elements 40 radially outwardly but also the tab element 50 forming a part of the tamper indicating means 16.

The tamper indicating package has been provided in which a threaded cap is applied to the threaded neck of a container and in which a tamper indicating means prevents opening movement until it is removed with such removal indicating that at the very least, the package has been placed in condition for opening thereby indicating the possibility of tampering with the contents in the container.

The embodiments of the invention in which an exclusive property or privilege is claimed are defined as follows:

1. A tamper indicating package comprising: a threaded closure, a container having a threaded neck to receive said closure, a lock member on said threaded neck below the threads and presenting a lock surface facing circumferentially in one direction and a ramp surface adjacent said lock surface and facing in the opposite circumferential direction, said closure including concentric inner and outer walls, a lock tab on said outer wall for engaging said lock surface upon opening rotation of said closure to prevent rotation beyond a predetermined point and being engageable with said ramp surface upon closing rotation to deflect said outer wall to pass said lock member upon rotation in a closing direction, said lock tab being deflectable radially outwardly to pass said lock surface upon radial inward squeezing of said outer wall at diametrically opposed points, a tamper indicating means detachably connected to said outer wall to maintain said lock tab circumferentially spaced from said lock surface in an initial position of said closure, ramp means on said container engageable with said outer skirt at said opposed points to prevent inner radial deflection of said diametrically spaced points when said closure in in said initial position, said tamper indicating element being removable from said closure to permit rotation in an opening direction from said initial position a limited amount to permit deflection of said radially spaced points for removal of said closure, said removed tamper indicating element giving evidence of possible prior opening.

2. The tamper indicating package of claim 1 wherein movement of said closure in an opening direction until said lock tab engages said lock surface simultaneously moves said diametrically opposed squeeze points to a position spaced from said ramp means in which said lock tab can be deflected radially outwardly to release said closure from said container.

3. The tamper indicating package of claim 1 wherein said lock tab depends from said outer skirt.

4. The tamper indicating package of claim 1 wherein said ramp means is disposed below said inner skirt and is engageable with said outer skirt.

5. The tamper indicating package of claim 1 wherein said tamper indicating means is a detachable portion to one side of said lock tab in the direction of opening movement.

6. The tamper indicating package of claim 5 wherein said lock tab is attached to said closure by frangible connectors.

7. The tamper indicating package of claim 5 wherein said tamper indicating means is provided with a gripping portion to permit tearing away of said tamper indicating element from said closure.

8. The tamper indicating and child resistant package of claim 1 wherein said container is equipped with two lock members and said closure is equipped with two lock tabs.

9. A tamper indicating and child resistant package including a threaded closure and a container having a threaded neck to receive said closure, said package comprising: a lock member on said container, a closure having a top with concentric inner and outer walls depending from said top, said inner wall having threads engageable with said threaded neck on said container, a lock element on said outer wall for engaging said lock member upon opening rotation of said closure to prevent rotation beyond predetermined point, said lock element being deflectable radially outwardly upon radial inward squeezing of said outer wall at diametrically opposed points to permit said lock element to pass said lock member and permit opening rotation of said closure, tamper indicating means detachably connected to said outer wall to engage said lock member and maintain said lock element circumferentially spaced from said lock member in an initial position, ramp means formed on said container to engage said outer wall at said opposed points when said closure is in said initial position to prevent radial inward squeezing, said tamper indicating element being detachable from said closure to permit movement of said closure circumferentially from said ramp means to permit opening movement of said closure and to give evidence of possible prior opening of said package.

10. The package of claim 1 wherein said ramp means are diametrically spaced from each other on said container and wherein said lock member is midway between said ramp means.

11. The package of claim 1 wherein said squeeze points are disposed midway between said lock member and said ramp means when said lock element is engaged with said lock member following removal of said tamper indicating means.

* * * * *